United States Patent [19]

Egger

[11] 4,022,414

[45] May 10, 1977

[54] BASKET WITH FOLDABLE LEGS

[76] Inventor: Charlotte Egger, Wulflingerstrasse 30, 8004 Winterthur, Switzerland

[22] Filed: Oct. 14, 1975

[21] Appl. No.: 621,766

[30] Foreign Application Priority Data

Oct. 25, 1974 Switzerland ..... 14373/74

[52] U.S. Cl. ..... 248/150; 248/439; 248/188.6; 108/132

[51] Int. Cl.[2] ..... A47G 23/02; F16M 11/32

[58] Field of Search ..... 248/146, 150, 167, 166, 248/434, 439, 188.1, 188.6, 151; 108/130, 131, 132, 133

[56] References Cited

UNITED STATES PATENTS

| | | | |
|---|---|---|---|
| 568,321 | 9/1896 | Whiting | 108/132 |
| 573,395 | 12/1896 | Davis | 248/289 |
| 1,223,065 | 4/1917 | Meyer | 248/439 |
| 1,306,306 | 6/1919 | McGregor | 248/439 |
| 2,767,948 | 10/1956 | Pieschel et al. | 248/151 |
| 2,804,989 | 9/1957 | Mango | 248/150 |
| 2,817,567 | 12/1957 | Shepherdson | 248/439 |

FOREIGN PATENTS OR APPLICATIONS

| | | | |
|---|---|---|---|
| 225,795 | 12/1924 | United Kingdom | 108/133 |
| 613,298 | 11/1948 | United Kingdom | 108/132 |

*Primary Examiner*—Robert A. Hafer
*Attorney, Agent, or Firm*—Toren, McGeady and Stanger

[57] ABSTRACT

A basket useful in hanging out wash has legs foldable from a support position into a recess formed in the underside of its bottom. A pair of U-shaped stirrups can be used as the legs with the stirrups located in the same plane in the folded position. The legs are spring-biased toward the opened or supporting position. Further, a displaceable pawl secures one of the legs in the folded position and another spring biases the pawl toward its locking position with the leg.

8 Claims, 4 Drawing Figures

BASKET WITH FOLDABLE LEGS

SUMMARY OF THE INVENTION

The present invention is directed to a multi-purpose basket which is particularly useful in hanging out wash and, more particularly, it concerns a foldable support arrangement for the basket.

When a housewife is hanging out wash it is cumbersome to remove individual items of the wash from a basket supported on the floor or ground and to hang the wash on a clothesline, since she must continuously bend up and down.

The primary object of the present invention is to provide a multi-purpose basket, particularly useful as a wash basket, which can be supported at a height which does not require the housewife to bend down to remove items from the basket.

In accordance with the present invention, support legs are pivotally secured to a multi-purpose basket so that they can be moved between a supporting position and a folded position against the bottom of the basket. In the support position, the legs locate the basket a distance above the ground or floor so that the contents of the basket are easily accessible to a person in the standing position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 3:
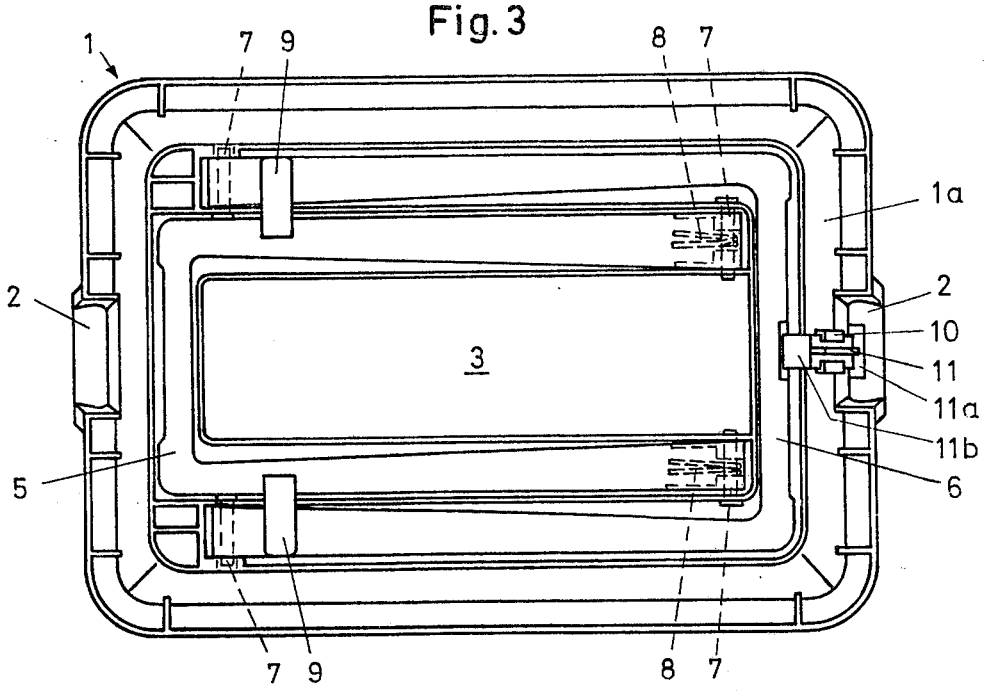
FIG. 3 is a bottom view of the basket shown in FIGS. 1 and 2 with the legs in the folded position.
Figure 4:
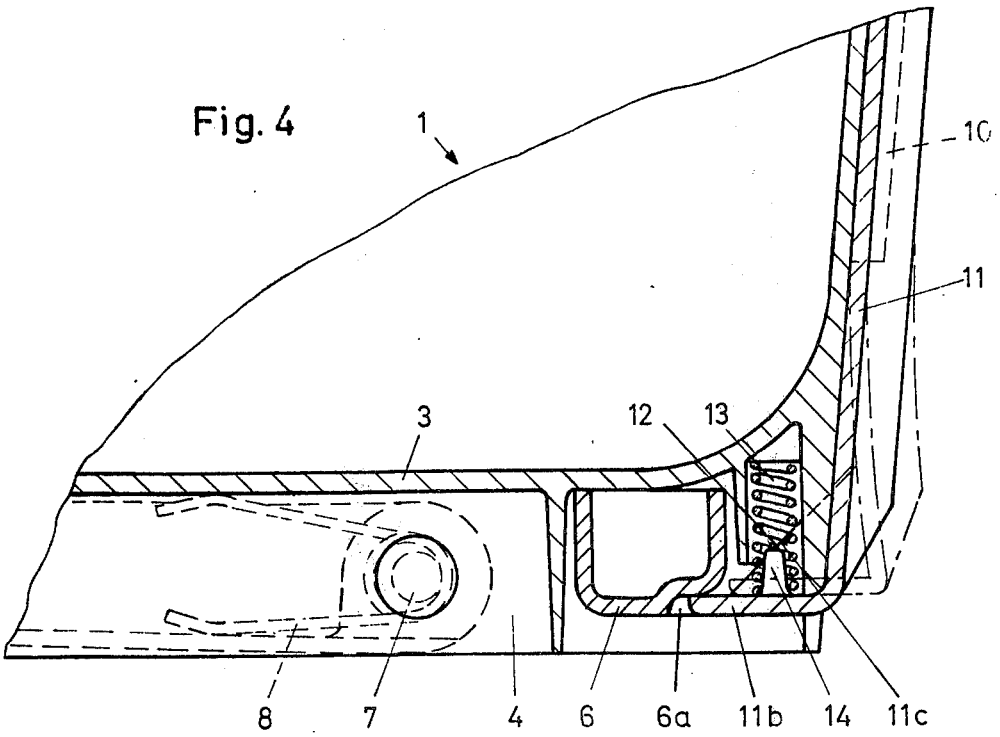
FIG. 4 is a partial vertical sectional view of the basket shown in FIGS. 1–3 with a locking pawl for one of the legs.

In the drawings a multi-purpose basket 1 formed of plastic is illustrated. The basket has a rectangularly shaped bottom or base 3 with side walls 1*a* extending upwardly from the bottom. The four side walls 1*a* project downwardly below the underside of the bottom 3 forming a recess or cavity 4 in which legs 5 and 6 of the basket can be located in the folded position or condition. Each of legs 5 and 6 is designed as a U-shaped stirrup with the free ends of each leg of the stirrup connected to the underside of the basket by a pivot pin 7. As shown in FIGS. 3 and 4, a spring 8 is positioned about each pivot pin 7 and in contact with the underside of the basket and the leg mounted on its associated pivot pin so that it tends to bias the leg from the folded position toward the supporting position. As can be seen in FIG. 3, the space between the legs of the U-shaped stirrup 6 is greater than the spacing between the outside of the legs of the U-shaped stirrup 5 and, as a result, in the folded position the stirrup 5 is positioned inwardly of the legs of the stirrup 6. Both of the stirrups extend in the same plane within the cavity 4 formed in the underside of the basket.

Figure 1:
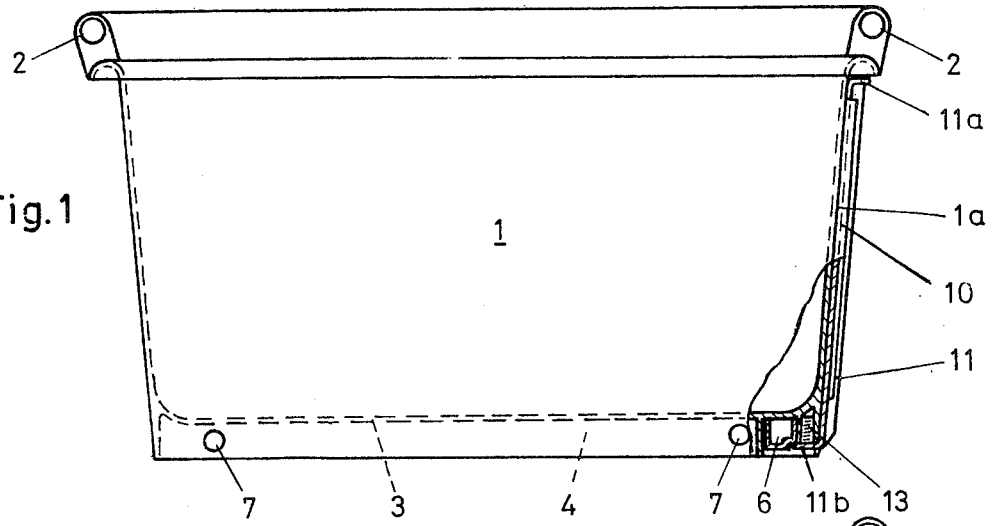
FIG. 1 is a side elevational view, partly in section, of a basket embodying the present invention with the legs in the folded position.
Figure 2:
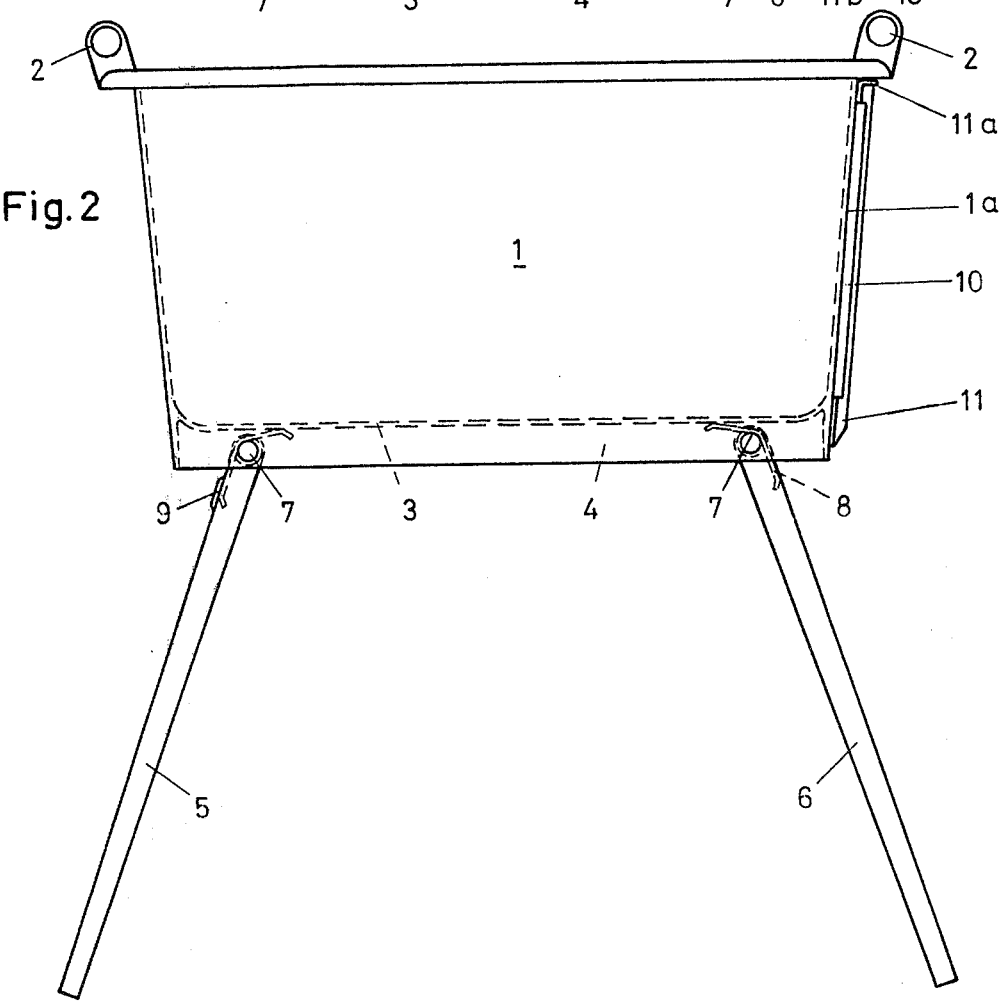
FIG. 2 is a side elevational view of the basket shown in FIG. 1 but with the legs folded out into the supporting position.

To lock the stirrups or legs 5, 6 in the folded position, a plate 9 is attached to the legs of the stirrup 6 adjacent the ends of the legs which are pivoted to the underside of the basket. Since a plate 9 is secured to each of the legs of the stirrup 6, each plate extends laterally over the adjacent leg of the other stirrup 5 in the folded position so that the stirrup 5 cannot be displaced outwardly from its folded position until stirrup 6 is displaced outwardly toward its supporting position. Further, the opposite end of the stirrup from its pivoted ends is locked by the pawl 11*b* as represented in FIGS. 1 and 4. Extending vertically along the center of one side wall 1*a*, note FIG. 3, is a guide bar 10 for a slide 11. At its upper end, the slide 11 has a grip 11*a* and the bottom of the slide is bent inwardly and forms the locking plate or pawl 11*b*. As illustrated in FIG. 4, the stirrup 6 has a recess 6*a* into which the locking pawl 11*b* seats for securing the stirrup or leg in the folded position. With the pawl 11*b* located in the recess 6*a* the stirrup 6 cannot be moved from the folded position to the supporting position and, because of the plates 9 on the stirrup 6, the other stirrup 5 is also secured in a locked position. The bottom of the basket just above the position of the pawl 11*b* shown in FIG. 4, has a surface 12 inclined at a 45° angle to the horizontal or to the plane of the bottom of the basket. Slide 11, immediately above the pawl 11*b* has a correspondingly inclined surface 11*c* which bears against the surface 12 in the locked folded position of the stirrups 5 and 6. When an upward pull is applied on the grip 11*a*, the slide 11 moves upwardly with the surface 11*c* sliding on the correspondingly inclined surface 12 of the basket causing the locking plate or pawl 11*b* to be displaced into the position represented by broken lines in FIG. 4 with the pawl released from locking engagement with the stirrup 6 so that both of the stirrups can be displaced into the supporting position as shown in FIG. 2.

The underside of the bottom 3 of the basket opposite the pawl 11*b* is shaped to receive a prestressed spring 13 which is held at its lower end by a pin 14 extending upwardly from the pawl. When the slide is pulled upwardly by the grip 11*a* and then released, the spring 13 biases the slide and its locking pawl back into the locking position. As the slide is lifted, the spring 13 is slightly compressed and bent slightly outwardly at its bottom end. It is also possible to provide a locking engagement for the leg or stirrup 5 by a similar slide 11.

This multi-purpose basket can be placed with its legs in the folded position on any plane surface in the same manner as a conventional basket with the legs recessed within the cavity 4 not being observable. When the legs are folded outwardly to the support position of FIG. 2 the basket can be placed on the ground or floor so that it is at a convenient height such as for use in hanging out wash or the like.

When used as a wash basket, an additional small receptacle for clothespins can be provided on at least one of the basket side walls.

The arrangement of the basket shown in the drawing is merely exemplary and different legs can be used embodying the general concept disclosed above.

While specific embodiments of the invention have been shown and described in detail to illustrate the application of the inventive principles, it will be understood that the invention may be embodied otherwise without departing from such principles.

What is claimed is:

1. A multi-purpose basket, particularly useful as a wash basket, comprising a basket member having a bottom and a top, legs pivotally secured to the bottom of said basket member and displaceable between a first position folded against the bottom of said basket member and a second position extending downwardly from said basket member for supporting said basket member above the ground or floor, at least one pivot pin being provided for each said leg and a spring being positioned on each said pivot pin in engagement with the bottom of said basket and said leg for biasing said leg into the second position, a pawl member located on the bottom of said basket member, said pawl member being displaceable between a locking position holding one of said legs in the first position and a releasing position so that said leg held in the first position can be moved to the second position, and a slide displaceably mounted on said basket, said slide extends and is displaceable in the upward direction of said basket between its bottom and top, said pawl connected to the lower end of said slide so that by pulling upwardly on said slide, said pawl member is displaced from locking engagement with one of said legs.

2. A multi-purpose basket, as set forth in claim 1, wherein said legs comprise a pair of U-shaped stirrups each pivotally connected to an opposite end of said basket, each said stirrup having a pair of laterally spaced legs and a bight portion connecting the stirrup legs, said stirrups being located in the same plane when located in the first position, one of said stirrups having an overall width outside its legs less than the width of the other said stirrup between its legs so that said stirrup of lesser width fits within the other said stirrup in the first position of said legs so that said stirrups are positionable in the same plane in the folded position, said pawl member arranged to lock said stirrup having the greater width, and a plate secured to each of said legs of said stirrup having the greater width and extending laterally therefrom over the legs of said stirrup having the lesser width for securing said stirrup having the lesser width in the locked position when said stirrup having the greater width is in the locked position.

3. A multi-purpose basket, as set forth in claim 1, wherein said basket has a surface at the edge of its bottom inclined to the horizontal when the bottom of said basket is in a horizontal position, said slide having a correspondingly shaped inclined surface disposed in contact with the inclined surface of said basket, said pawl member located below the inclined surface on said slide and when said slide is pulled upwardly the movement of the inclined surface thereon relative to the inclined surface on the bottom of said basket displaces said pawl member outwardly from the locking position with one of said legs.

4. A multi-purpose basket, as set forth in claim 3, wherein a spring is mounted on the bottom of said basket and is disposed in engagement with said pawl member, said spring extending in the upward direction of said basket and biasing said pawl member into its locking position so that when said pawl member is displaced into its releasing position said spring acts to return said pawl member into its locking position.

5. A multi-purpose basket, as set forth in claim 4, wherein said basket is shaped to form a cavity in the under portion of its bottom and said legs are received within said cavity in the first position of said legs.

6. A multi-purpose basket, as set forth in claim 4, wherein said spring is a helical spring and a pin is formed on said pawl member with said pin extending axially into one end of said helical spring for effecting the securement of said spring to said pawl member.

7. A multi-purpose basket, as set forth in claim 1, wherein a handle is formed on the upper end of said slide for lifting said slide.

8. A multi-purpose basket, as set forth in claim 3, wherein the inclined surface on the bottom of said basket and the correspondingly inclined surface on said slide are inclined at an angle of 45° to the horizontal when the bottom of the basket is positioned in the horizontal plane.

* * * * *